United States Patent [19]

Hata et al.

[11] Patent Number: 4,639,640

[45] Date of Patent: Jan. 27, 1987

[54] RESISTORS FOR USE IN CATHODE RAY TUBES

[75] Inventors: Katsuhiko Hata; Takahiko Yamakami, both of Aichi, Japan

[73] Assignee: Sony Corporation, Tokyo, Japan

[21] Appl. No.: 682,247

[22] Filed: Dec. 17, 1984

[30] Foreign Application Priority Data

Dec. 16, 1983 [JP] Japan ..... 58-238244

[51] Int. Cl.[4] ..... H01J 23/16

[52] U.S. Cl. ..... 315/3; 315/58

[58] Field of Search ..... 315/3, 58; 313/477 HC; 338/283, 293

[56] References Cited

U.S. PATENT DOCUMENTS 4,349,767 9/1982 Muramoto et al. ..... 315/3 X 4,366,415 12/1982 Takenaka et al. ..... 315/3 X

*Primary Examiner*—David K. Moore

*Attorney, Agent, or Firm*—Hill, Van Santen, Steadman & Simpson

[57] ABSTRACT

A resistor for use in a cathode ray tube comprises an insulating plate provided thereon with at least first and second electrode terminals for use respectively with relatively high and low voltages in the cathode ray tube, a coating insulator provided on the insulating plate for covering the same, and a resistive layer provided in a predetermined pattern on the insulating plate to connect therethrough the first and second electrode terminals with each other and to be covered by the coating insulator with such an arrangement that the resistance thereof obtained per unit length on the insulating plate between the second electrode terminal and a high potential difference position between the first and second electrode terminals, where the potential difference between the outer surface of the coating insulator and the resistive layer is to be relatively large in the use of the resistor in the cathode ray tube, is greater than that between the high potential difference position and the first electrode terminal.

9 Claims, 12 Drawing Figures

RESISTORS FOR USE IN CATHODE RAY TUBES

BACKGROUND OF THE INVENTION

1. Field of the Invention

The present invention relates generally to resistors for dividing a high voltage in cathode ray tubes, and more particularly, to a resistor used in combination with an electron gun assembly in a cathode ray tube for breeding relatively high voltages required to be applied to the electrodes of the electron gun assembly.

2. Description of the Prior Art

There has been proposed a color cathode ray tube used in a color television receiver in which relatively high voltages are required to be supplied to convergence electrodes for converging a plurality of electron beams, focus electrodes for focusing each of the electron beams and so on, in addition to an anode voltage. In such a color cathode ray tube, a resistor is used in combination with an electron gun assembly containing the convergence electrodes, focus electrodes and other electrodes for dividing the anode voltage to breed the relatively high voltages supplied to the respective electrodes.

A previously proposed resistor for use in the color cathode ray tube in the manner as mentioned above is shown in FIGS. 1 and 2. FIG. 1 is a plane view showing a resistor 7 previously proposed with a major part thereof shown through a coating insulator forming an exterior portion, and FIG. 2 is a side view showing the resistor 7 entirely. The resistor 7 has an insulating plate 1 made of, for example, ceramics and provided with a plurality of terminals formed by separate conductive layers put on the surface thereof, respectively. These terminals contain an anode electrode terminal 2 for being supplied with the anode voltage, a convergence electrode terminal 3 for delivering the relatively high voltage supplied to the convergence electrodes, that is, a convergence voltage, and an earth electrode terminal 4. Then, a voltage dividing resistive layer 5 is also put on the surface of the insulating plate 1. This voltage dividing resistive layer 5 comprises a partial resistive layer 5*a* formed in the zigzag pattern with a predetermined resistance to connect the convergence electrode terminal 3 with the earth electrode terminal 4, another partial resistive layer 5*b* formed in the zigzag pattern also with a predetermined resistance to connect the anode electrode terminal 2 with the convergence electrode terminal 3, and an adjusting resistive layer 5*c* provided to couple with the convergence electrode terminal 3 and the partial resistive layers 5*a* and 5*b*. The resistance of each of the partial resistive layers 5*a* and 5*b* can be adjusted by removing the adjusting resistive layer 5*c* partially in the manufacturing process of the resistor 7. Further, at the hatched portion on the insulating plate 1, a coating insulator 6 of, for example, flint glass is provided to cover the voltage dividing resistive layer 5.

The resistor 7 thus constituted is used in a color cathode ray tube in such a manner as illustrated in FIG. 3. In FIG. 3, an electron gun assembly 9 is disposed in a neck portion 8*a* of a body of tube 8 of the color cathode ray tube, and has three cathodes K, an arrangement of a first grid electrode G1, a second grid electrode G2, a third grid electrode G3, a fourth grid electrode G4 and a fifth grid electrode G5 aligned in common to the three cathodes K, and convergence electrodes 10 provided next to the fifth grid electrode G5. The first to fifth grid electrodes G1 to G5 and the convergence electrodes 10 are connected mechanically with a beading glass 11 to be supported in common thereby, and the third and fifth grid electrodes G3 and G5 are coupled electrically with each other through a conductive wire 13. The convergence electrodes 10 comprises a pair of inner deflecting electrode plates 10*a* and 10*b* faced to each other and connected electrically to the fifth grid electrode G5 through a conducting plate 14 and a pair of outer deflecting electrode plates 10*c* and 10*d* provided to face to the inner deflecting electrode plates 10*a* and 10*b*, respectively.

The resistor 7 as shown in FIGS. 1 and 2 is attached to the electron gun assembly 9 with the anode electrode terminal 2 connected through a conductive connecting piece 12 to the fifth grid electrode G5. On the inner surface of a funnel portion 8*b* of the body of tube 8, a graphite coating 15 is provided to extend to the inner surface of the neck portion 8*a*, and the anode voltage is applied through a high voltage supplying button, that is, an anode button (not shown in Figures) built in the funnel portion 8*b* to the graphite coating 15. The conducting plate 14 is provided with conductive springs 16 which come into contact with the graphite coating 15 so that the anode voltage is supplied to the fifth grid electrode G5, the third grid electrode G3, the inner deflecting electrode plates 10*a* and 10*b* of the convergence electrodes 10 and the anode electrode terminal 2 of the resistor 7. The convergence electrode terminal 3 of the resistor 7 is connected through a conductive connecting piece 17 to the outer deflecting electrode plates 10*c* and 10*d* of the convergence electrodes 10 and the earth electrode terminal 4 of the resistor 7 is connected with an earth electrode terminal pin 19 fixed through a stem portion 18 at the end of the neck portion 8*a* of the body of tube 8 to be grounded directly or through a variable resistor provided in the outside of the body of tube 8, so that the convergence voltage obtained at the convergence electrode terminal 3 as a result of the division of the anode voltage by the partial resistive layers 5*a* and 5*b* is supplied to the outer deflecting electrode plates 10*c* and 10*d* of the convergence electrodes 10.

In the color cathode ray tube containing the electron gun assembly 9 and the resistor 7 therein as mentioned above, if the electron gun assembly 9 has sharp-pointed projections thereon, undesirable electric discharge may occur at some of the sharp-pointed projections in actual use. Accordingly, the color cathode ray tube is subjected to the knocking treatment in the manufacturing process thereof in which such portions as the sharp-pointed projections on the electron gun assembly 9 where electric discharge is likely to occur are caused positively to have electric discharge thereat previously to be reformed with melting away, for the purpose of stabilizing the operation thereof in practical use. In the knocking treatment, the third and fifth grid electrodes G3 and G5 of the electron gun assembly 9 and the anode electrode terminal 2 of the resistor 7 are supplied with a high voltage (knocking voltage) which is twice to third times as high as the anode voltage in the practical use of the color cathode ray tube, and the first, second and fourth grid electrodes G1, G2 and G4 are grounded.

In the situation of such knocking treatment, the outer surface of the coating insulator 6 forming the exterior of the resistor 7 is electrically charged to be at relatively high potential except for a certain part thereof, and the coating insulator 6 is applied a voltage higher than that in the practical use of the cathode ray tube particularly on the low voltage side of the partial resistive layer 5*a*. FIG. 4 shows the potential on the outer surface of the coating insulator 6 and the potential on the partial resistive layer 5*a* provided between the earth electrode terminal 4 and the convergence electrode terminal 3 under the knocking treatment with curves a and b, respectively, and further the difference between the potentials shown with the curves a and b, respectively, with a curve c in the graphic illustration having the axis of ordinates representing voltage V and the axis of abscissas representing distance L measured on the surface of the insulating plate 1 from the earth electrode terminal 4 toward the convergence electrode terminal 3 of the resistor 7 and shown with reference to the resistor 7 and the electron gun assembly 9. As apparent from this illustration in FIG. 4, the potential difference between the partial resistive layer 5*a* and the outer surface of the coating insulator 6 reaches the maximum at a position P close to the third grid electrode G3 supplied with the knocking voltage on the low voltage side of the partial resistive layer 5*a*, and therefore, the maximum voltage is applied to the coating insulator 6 at the position P. Consequently, it is feared that a voltage exceeding the upper limit of the resistible voltage for the coating insulator 6 is applied to the coating insulator 6 at the position around the third grid electrode G3 of the electron gun assembly 9 so as to bring deterioration in dielectric strength or dielectric breakdown on the coating insulator 6 and, as a result, the partial resistive layer 5*a* is damaged to vary its resistance conspicuously.

Against such variations in the resistance of partial resistive layer 5*a* resulting from the deterioration in dielectric strength or dielectric breakdown brought on the coating insulator 6 as mentioned above, it may be advantageous that the coating insulator 6 is given an increased thickness to have raised dielectric strength. That is, it is possible to prevent the deterioration in dielectric strength or dielectric breakdown from being brought on the coating insulator 6 and thereby to restrain the variations in the resistance of partial resistive layer 5*a* by means of making the coating insulator 6 have an increased thickness.

However, it is disadvantageous for the production cost of the resistor 7 to increase the thickness of the coating insulator 6 indiscreetly. Further, the coating insulator 6 with the increased thickness may cause the problem that the resistor 7 is undesirably warped due to difference in the coefficient of thermal expansion between the insulating plate 1 and the coating insulator 6, and the coating insulator 6 comes to exfoliate from the insulating plate 1 or comes to be cracked through the repetition of an increase in temperature of the resistor 7 in the operative state and a decrease in temperature of the resistor 7 in the inoperative state occuring alternately. This results in that the reliability of the resistor 7 is lowered.

OBJECTS AND SUMMARY OF THE INVENTION

Accordingly, it is an object of the present invention to provide a resistor for use in a cathode ray tube which avoids the foregoing disadvantage and problem of the prior art.

Another object of the present invention is to provide a resistor for use in a cathode ray tube which is formed with a resistive layer put in a predetermined pattern on an insulating plate and a coating insulator covering the resistive layer, and which can restrain variations in the resistance of the resistive layer through the knocking treatment to which a cathode ray tube employing the resistor is subjected, without increasing the production cost and lowering the reliability.

A further object of the present invention is to provide a resistor for use in a cathode ray tube which is formed with a resistive layer put in a predetermined pattern on an insulating plate and a coating insulator covering the resistive layer, and which can avoid deterioration in dielectric strength or dielectric breakdown caused on the coating insulator through the knocking treatment to which a cathode ray tube employing the resistor is subjected, without increasing the thickness of the coating insulator.

In accordance with an aspect of the present invention, there is provided a resistor for use in a cathode ray tube comprising an insulating plate having a surface on which at least first and second electrode terminals for being used respectively with relatively high and low voltages are fixed, a coating insulator provided on the surface of the insulating plate for covering the same, and a resistive layer provided in a predetermined pattern on the surface of the insulating plate for coupling therethrough the first and second electrode terminals with each other and being covered by the coating insulator, and so arranged that the resistance thereof obtained per unit length on the insulating plate between the second electrode terminal and a high potential difference position on the first and second electrode terminals, where the potential difference between the outer surface of the coating insulator and the resistive layer is to be relatively large when the resistor is used in the cathode ray tube, is greater than that between the high potential difference position and the first electrode terminal.

With the resistor thus constituted in accordance with the present invention, when the first and second electrode terminals on the insulating plate are used with the relatively high and low voltages, respectively, in practice, the potential on the resistive layer has a steeply increasing gradient from the second electrode terminal to the high potential difference position on the insulating plate and therefore the potential on the resistive layer in the area around the high potential difference position is increased so that the potential difference between the surface of the coating insulator and the resistive layer, that is, the voltage applied to the coating insulator is reduced therein. As a result of this, the coating insulator is held to be appropriate without having deterioration in dielectric strength or dielectric breakdown and consequently the resistance of the resistive layer is prevented from varying conspicuously, even at the high potential difference position, through the knocking treatment to which a cathode ray tube employing the resistor is subjected.

For achieving such an arrangement that the resistance of the resistive layer obtained per unit length on the insulating plate between the second electrode terminal and the high potential difference position is greater than that between the high potential difference position and the first electrode terminal, the following embodiments are taken by way of examples.

In an embodiment, the resistive layer on the insulating plate is made of substantially homogeneous resistive material with a constant sectional area and formed in such a specific pattern that the substantial length of the resistive layer in the unit length on the insulating plate between the second electrode terminal and the high potential difference position is longer than that between the high potential difference position and the first electrode terminal.

In another embodiment, the resistive layer on the insulating plate is made partially of different resistive material or with different sectional areas so that the resistance in a unit length of the resistive layer between the second electrode terminal and the high potential difference position is larger than that between the high potential difference position and the first electrode terminal.

In each of other embodiments, the resistive layer on the insulating plate is derived from a combination of the embodiments mentioned above.

The above, and other objects, features and advantages of the invention will be apparent from the following detailed description which is to be read in conjunction with the accompanying drawings.

DETAILED DESCRIPTION OF THE PREFERRED EMBODIMENTS

Now, embodiments of resistor for use in a cathode ray tube according to the present invention will be described with reference to the accompanying drawings hereinafter.

Figure 1:
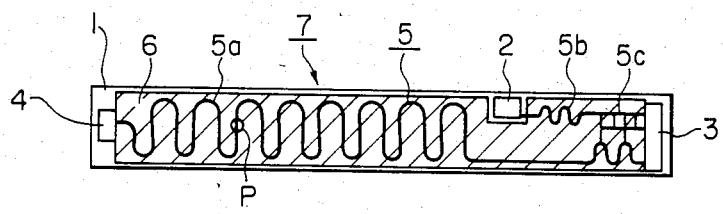
FIG. 1 (PRIOR ART)
FIGS. 1 and 2 are plane and side views showing a previously proposed resistor for use in a cathode ray tube, respectively.
Figure 5:
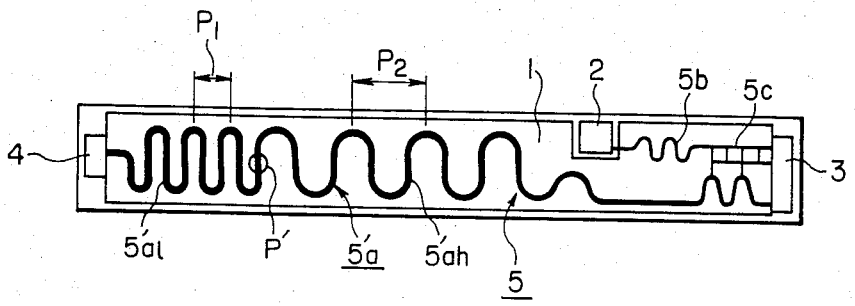
FIG. 5 is a plane view showing an embodiment of resistor for use in a cathode ray tube according to the present invention.

FIG. 5 shows an example of the resistor according to the present invention with a major part thereof viewed through a coating insulator forming an exterior portion, in the same manner as FIG. 1. In FIG. 5, elements and parts corresponding to those of FIGS. 1 and 2 are marked with the same references and further description thereof will be omitted.

Figure 2:
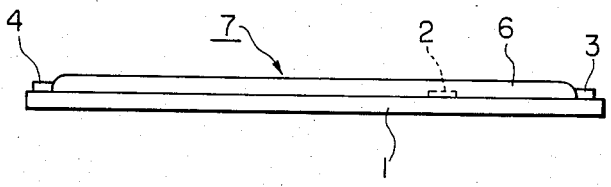
FIG. 2 (PRIOR ART)

In this example of the resistor according to the present invention, the voltage dividing resistive layer 5 which is put on the surface of the insulating plate 1 and covered by the coating insulator of flint glass (not shown in FIG. 5) comprises a partial resistive layer **5'*a* formed in the zigzag pattern to connect the convergence electrode terminal 3 with the earth electrode terminal 4, the partial resistive layer 5*b* formed also in the zigzag pattern to connect the anode electrode terminal 4 with the convergence electrode terminal 3 and the adjusting resistive layer 5*c* provided to couple with the convergence electrode terminal 3 and the partial resistive layers 5'*a* and 5*b*, in the similar manner as the resistor shown in FIGS. 1 and 2**.

Figure 3:
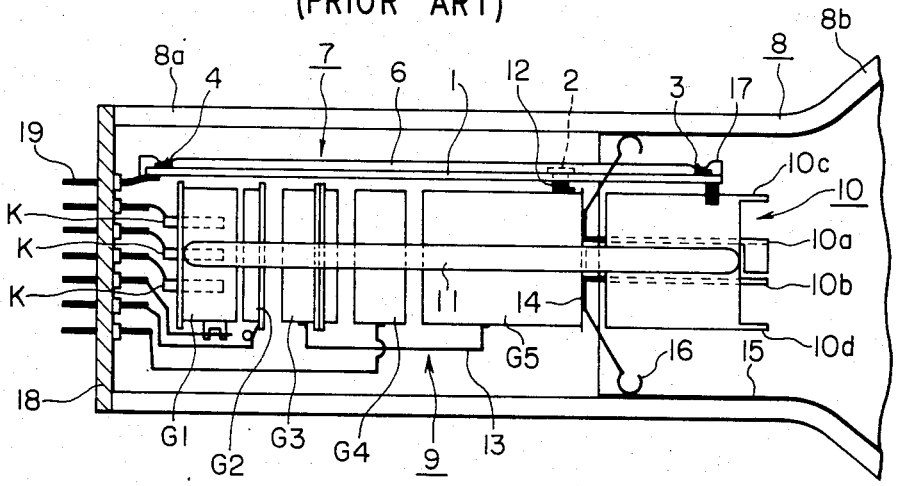
FIG. 3 (PRIOR ART)
FIG. 3 is a schematic side view showing a portion of a cathode ray tube employing the resistor shown in FIGS. 1 and 2.
Figure 4:
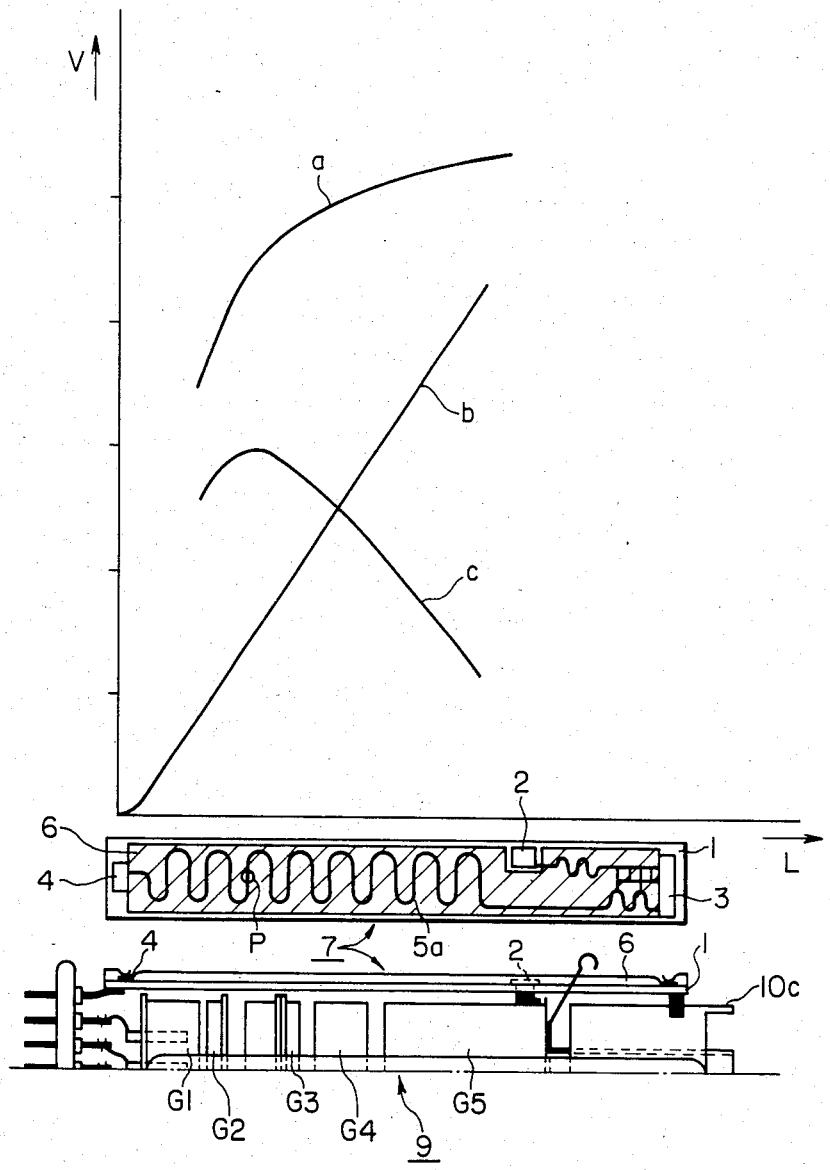
FIG. 4 (PRIOR ART)
FIG. 4 is an illustration used for explanation of the potential relation on the resistor employed in the cathode ray tube shown in FIG. 3.

The voltage dividing resistive layer 5 is made of substantially homogeneous resistive material with a substantially constant sectional area. The partial resistive layer **5'*a* is formed in the zigzag pattern with a substantially constant meandering width in its entirety and comprises a lower portion 5'*al* provided with a small meandering pitch $p_1$ between the earth electrode terminal 4 and a position P' on the insulating plate 1 which corresponds to the position P in the resistor 7 shown in FIGS. 1, 2 and 4, and a upper portion 5'*ah* provided with a large meandering pitch $p_2$ ($p_2 > p_1$) between the position P' and the convergence electrode terminal 3 to be successive to the lower portion 5'*al*. The position P' is provided at a location where potential difference between the partial resistive layer 5'*a* and the outer surface of the coating insulator reaches the maximum when the resistor is used in combination with the electron gun assembly 9 in the color cathode ray tube as shown in FIG. 3 and supplied with the anode voltage to the anode electrode terminal 2**. (The position P' is referred to as the maximum potential difference position, hereinafter.)

In the partial resistive layer **5'*a* thus contained in the voltage dividing resistive layer 5 put on the insulating plate 1, the substantial length of the lower portion 5'*al* having the small pitch $p_1$ in the unit length on the insulating plate 1 between the earth electrode terminal 4 and the maximum potential difference position P' is longer than the substantial length of the upper portion 5'*ah* having the large pich $p_2$ in the unit length on the insulating plate 1 between the maximum potential difference position P' and the convergence electrode terminal 3. Therefore, the resistance of the partial resistive layer 5'*a* obtained per the unit length on the insulating plate 1 between the earth electrode terminal 4 and the maximum potential difference position P' is larger than that between the maximum potential difference position P' and the convergence electrode terminal 3**.

Figure 6:
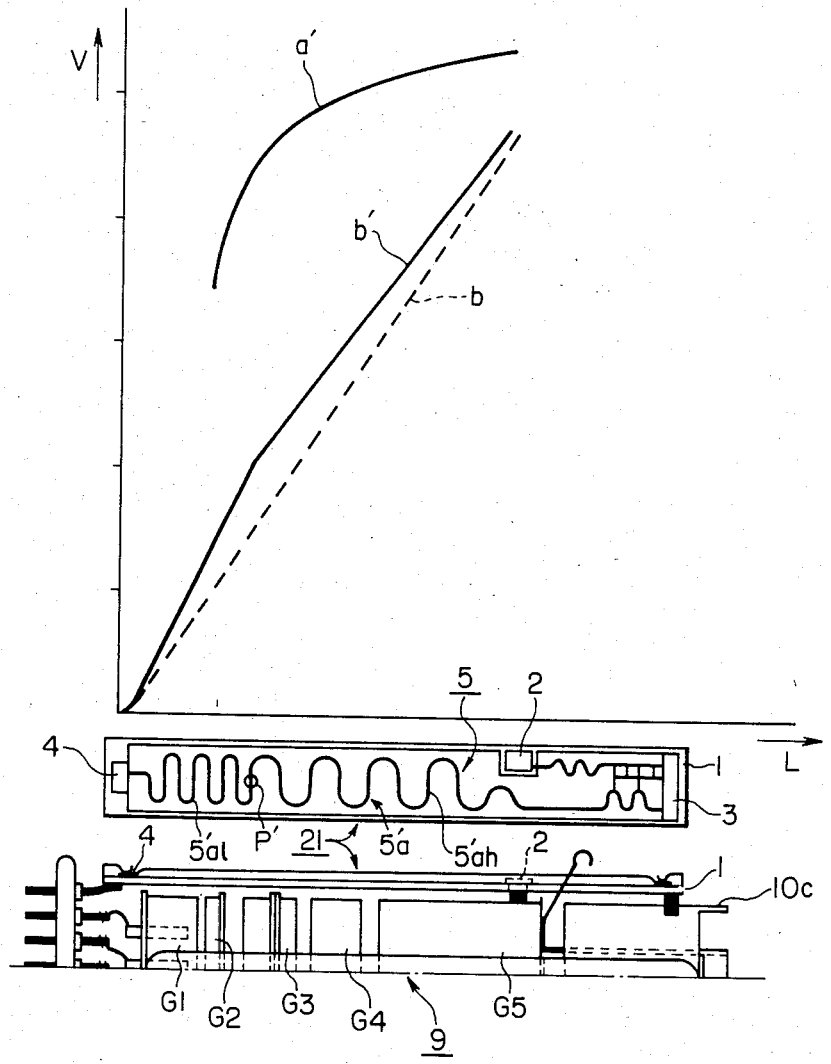
FIG. 6 is an illustration used for explaining the potential relation on the embodiment shown in FIG. 5.

Accordingly, in the case where the resistor shown in FIG. 5 is employed in combination with the electron gun assembly 9 in the color cathode ray tube as shown in FIG. 3 in the same manner as the resistor 7 previously proposed, and the knocking voltage and the earth potential are supplied to the anode electrode terminal 2 and the earth electrode terminal 4, respectively, under the knocking treatment to which the color cathode ray tube is subjected, the postential on the lower portion **5'*al* of the partial resistive layer 5'*a* varies with a steeply increasing gradient from the earth electrode terminal 4 to the maximum potential difference position P', and to the contrary, the potential on the upper portion 5'*ah* the partial resistive layer 5'*a* varies with a slowly increasing gradient from the maximum potential difference position P' to the convergence electrode terminal 3, as shown with a curve b' in the graphic illustration having the axis of ordinates representing voltage V and the axis of abscissas representing distance L measured on the surface of the insulating plate 1 from the earth electrode terminal 4 toward the convergence electrode terminal 3 shown in FIG. 6. Consequently, the potential on the partial resistive layer 5'*a*** is increased in its entirety with the maximum potential difference positon P' as the central figure in comparison with the corresponding potential on the resistor 7 previously proposed which is shown with the curve b in FIG. 6. As a result of this, the difference between the potential on the outer surface of the coating insulator as shown with a curve a' in FIG. 6 and the potential on the partial resistive layer 5'a, that is, the voltage applied to the coating insulator is reduced in comparison with the corresponding voltage applied to the coating insulator 6 of the resistor 7 previously proposed.

In this case, assuming that the substantial length of the lower portion 5'al of the partial resistive layer 5'a is X1, the substantial length of the upper portion 5'ah of the partial resistive layer 5'a is Xh, the potential at the convergence electrode terminal 3 is Vc and the potential at the earth electrode terminal 4 is Ve, the potential V'p on the partial resistive layer 5'a at the maximum potential difference position P' is expressed as follows;

$$V'p = Ve + (Vc - Ve) \cdot X1/(X1 + Xh).$$

Further, assuming that the potential on the coating insulator at the maximum potential difference position P' is Vs, the potential difference (Vs−V'p) applied to the coating insulator is expressed as follows;

$$Vs - V'p = Vs - Ve - (Vc - Ve) \cdot X1/(X1 + Xh).$$

Accordingly, each of the substantial length X1 and the substantial length Xh is selected so that the potential difference (Vs−V'p) as expressed above is smaller than the upper limit of the resistible voltage for the coating insulator.

Figure 7:
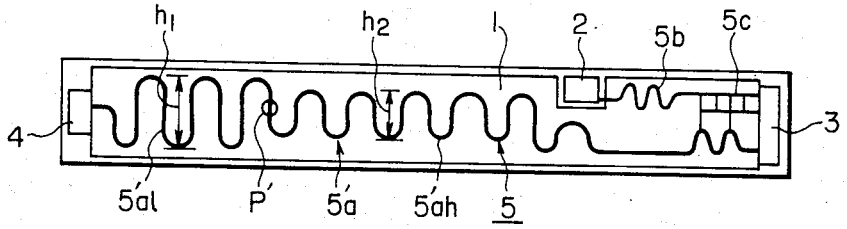
FIGS. 7, 8, 9, 10 and 11 are plane and side views showing other embodiments of resistor for use in a cathode ray tube according to the present invention.

FIG. 7 shows another example of the resistor according to the present invention. This example has also the partial resistive layer 5'a which is made of substantially homogeneous resistive material with a substantially constant sectional area and formed in the zigzag pattern to connect the convergence electrode terminal 3 with the earth electrode terminal 4, and comprises the lower portion 5'al and the upper portion 5'ah successive to the lower portion 5'al. In this example, however, the lower and upper portions 5'al and 5'ah are formed in the zigzag pattern with substantially the same meandering pitch and the respective meandering widths different from each other. The meandering width $h_1$ of the lower portion 5'al is larger than the meandering width $h_2$ of the upper portion 5'ah ($h_1 > h_2$), as shown in FIG. 7.

Accordingly, in this example also, the substantial length of the lower portion 5'al in the unit length on the insulating plate 1 between the earth electrode terminal 4 and the maximum potential difference position P' is longer than the substantial length of the upper portion 5'ah in the unit length on the insulating plate between the maximum potential difference position P' and the convergence electrode terminal 3, and therefore, the effective advantage such as obtained in the example shown in FIG. 5 is also obtained.

FIGS. 8 to 11 show other examples of the resistor according to the present invention. Each of these examples has the partial resistive layer 5'a which is formed in the zigzag pattern on the insulating plate 1 to connect the convergence electrode terminal 3 with the earth electrode terminal 4 and comprises the lower and upper portions 5'al and 5'ah with a substantially constant meandering width in the same manner as the example shown in FIG. 5, and the lower and upper portions 5'al and 5'ah are so arranged that the resistance of the lower portion 5'al in a unit length thereof is larger than the resistance of the upper portion 5'ah in a unit length thereof. Therefore, in each example, the resistance of the partial resistive layer 5'a obtained per the unit length on the insulating plate 1 between the earth electrode terminal 4 and the maximum potential difference position P' is larger than that between the maximum potential difference position P' and the convergence electrode terminal 3, and consequently, the effective advantage such as obtained in the example shown in FIG. 5 is also obtained.

Figure 8:
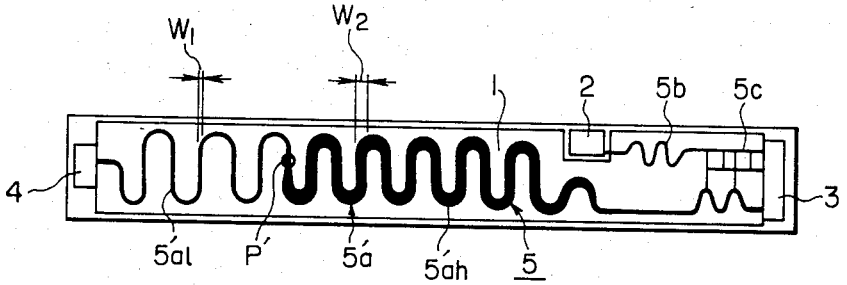

In the example shown in FIG. 8, the partial resistive layer 5'a is made of substantially homogeneous resistive material, and the width $w_1$ of the resistive layer in the lower portion 5'al is narrower than the width $w_2$ of the resistive layer in the upper portion 5'ah sp that the sectional area of the resistive layer in the lower portion 5'al is smaller than that in the upper portion 5'ah.

Figure 9:
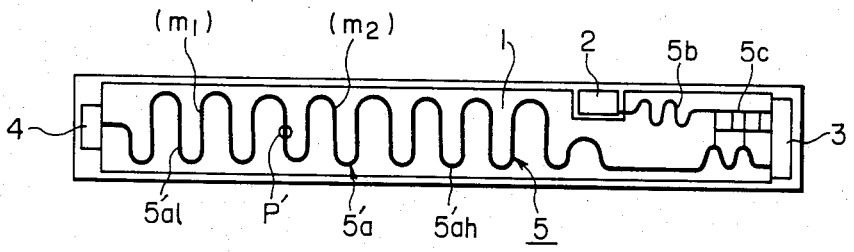

In the example shown in FIG. 9, each of the lower and upper portions 5'al and 5'ah of the partial resistive layer 5'a is made of different resistive materia, and the specific resistance $m_1$ of the resistive material used for making the lower portion 5'al is larger than the specific resistance $m_2$ of the resistive material used for making the upper portion 5'ah.

Figure 10:
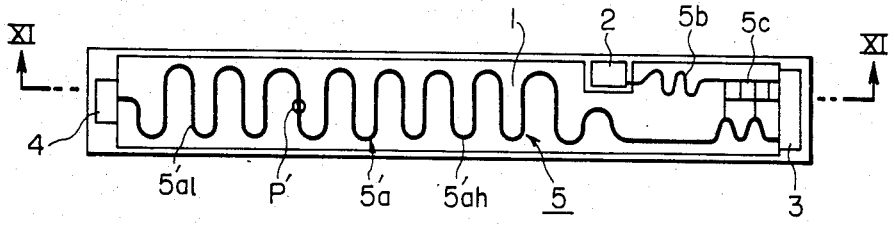
Figure 11:
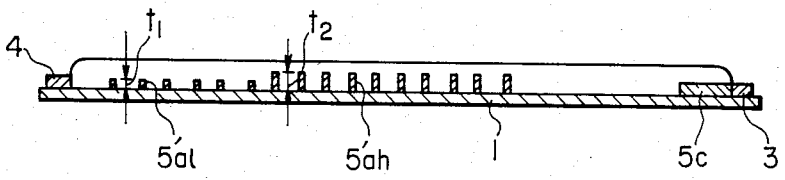

In the example shown in FIG. 10 and FIG. 11 showing the cross section indicated by a line X1—X1 in FIG. 10, the partial resistive layer 5'a is made of substantially homogeneous pesistive material, and the thickness $t_1$ of the resistive layer in the lower portion 5'al is smaller than the thickness $t_2$ of the resistive layer in the upper portion 5'ah so that the sectional area of the resistive layer in the lower portion 5'al is smaller than that in the upper portion 5'ah.

As described above, in each of the examples shown in FIGS. 8 to 11, such an arrangement that the resistance of the partial resistive layer 5'a obtained per the unit length on the insulating plate between the earth electrode terminal 4 and the maximum potential difference position P' is made larger than that between the maximum potential difference position P' and the convergence electrode terminal 3 is taken in the respective manner as aforementioned. Accordingly, in the case where the resistor shown in one of FIGS. 8 to 11 is employed in combination with the electron gun assembly 9 in the color cathode ray tube as shown in FIG. 3 in the same manner as the resistor 7 previously proposed, and the knocking voltage and the earth potential are supplied to the anode electrode terminal 2 and the earth electrode terminal 4, respectively, under the knocking treatment to which the color cathode ray tube is subjected, the potential on the partial resistive layer 5'a is increased in its entirety with the maximum potential difference position P' as the central figure in comparison with the corresponding potential on the resistor 7 previously proposed, and as a result of this, the difference between the potential on the outer surface of the coating insulator as shown with the curve a' in FIG. 6 and the potential on the partial resistive layer 5'a, that is, the voltage applied to the coating insulator is reduced in comparison with the corresponding voltage applied to the coating insulator 6 of the resistor 7 previously proposed.

In the above case, assuming that the resistance of the lower portion 5'al of the partial resistive layer 5'a is R1, the resistance of the upper portion 5'ah of the partical resistive layer 5'a is Rh, the potential at the convergence electrode terminal 3 is Vc and the potential at the earth electrode terminal 4 is Ve, the potential V'p on the partial resistive layer 5'a at the maximum potential difference position P' is expressed as follows;

$$V'p = Ve + (Vc - Vc) \cdot R1/(R1 + Rh).$$

Further, assuming that the potential on the coating insulator at the maximum potential difference position P' is Vs, the potential difference (Vs−V'p) applied to the coating insulator is expressed as follows;

$$Vs - V'p = Vs - Ve - (Vc - Ve) \cdot R1/(R1 + Rh).$$

Accordingly, each of the resistance R1 and the resistance Rh is selected so that the potential difference (Vs−V'p) as expressed above is smaller than the upper limit of the resistible voltage for the coating insulator.

Figure 12:
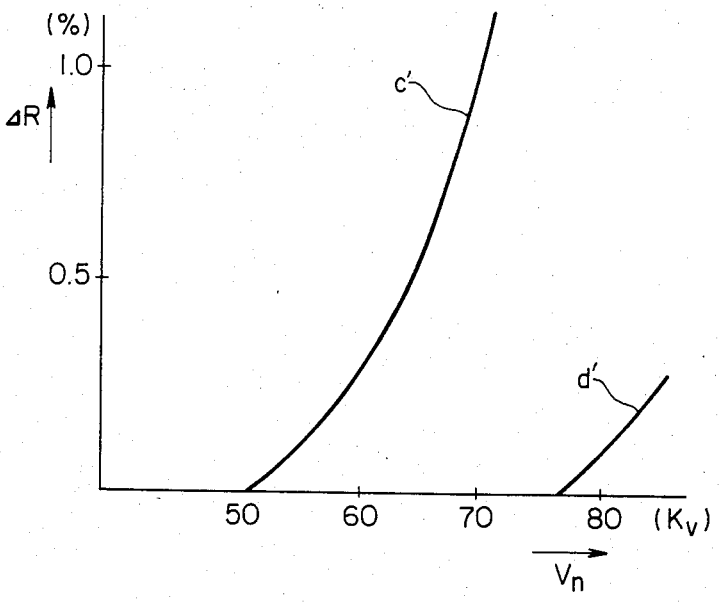
FIG. 12 is a graphic illustration used for explaining variations in resistance of the resistor previously proposed and the resistor according to the present invention.

FIG. 12 shows an example of the relation between a knocking voltage and variations in the resistance of the partial resistive layer 5a of the resistor 7 previously proposed to which the knocking voltage is supplied under the knocking treatment, obtained through experiment, with a curve c' and an example of the relation between a knocking voltage and variations in the resistance of the partial resistive layer 5'a of the resistor according to the present invention to which the knocking voltage is supplied under the knocking treatment, obtained through experiment, with a curve d' in the graphic illustration having the axis of ordinates representing variations in resistance ΔR and the axis of abscissas representing knocking voltage Vn. From these relations, it is understood that the partial resistive layer 5'a of the resistor according to the present invention does not cause variations in its resistance under the condition of the conventional knocking treatment, but has restrained small variations under the condition of a knocking treatment in which an extremely high knocking voltage is applied to the resistor.

In addition to the aforementioned embodiments, the resistor according to the present invention can be formed to have the partial resistive layer 5'a which corresponds to the combination of those employed in two or more of the examples mentioned above.

Although the boundary between the lower and upper portions 5'al and 5'ah of the partial resistive layer 5'a on the insulating plate 1 is arranged to coincide with the maximum potential difference position P' in the embodiments mentioned above, it is to be understood that the resistor according to the present invention is not limited to these embodiments, and such a boundary between the lower and upper portions 5'al and 5'ah in the resistor according to the present invention can be arranged to be at a position on the insulating plate 1 close to the maximum potential difference position P'.

As apparent from the above description, in the resistor according to the present invention, since the potential difference between the resistive layer put on the insulating plate and the outer surface of the coating insulator covering the resistive layer is effectively reduced particularly at the position where such a potential difference reaches a relatively large value when the resistor is used to be supplied with a relatively high voltage in a cathode ray tube, the coating insulator is held to be appropriate without having deterioration in dielectric strength or dielectric breakdown even in the condition wherein a high knocking voltage is applied to the resistor under the knocking treatment to which the cathode ray tube employing the resistor is subjected, and therefore variations in the resistance of the resistive layer is restrained to the minimum. Further, since a coating insulator of increased thickness is not used, the resistor according to the present invention is prevented from being undesirably warped due to dufference in the coefficient of the thermal expansion between the insulating plate and the coating insulator and from being troubled by the coating insulator exfoliating from the insulating plate or being cracked, and can be manufactured at relatively low cost.

What is claimed is:

1. A resistor for use in a cathode ray tube comprising an insulating plate provided thereon with at least first and second electrode terminals for use respectively with relatively high and low voltages in the cathode ray tube, a coating insulator provided on said insulating plate for covering the same, and a resistive layer provided in a predetermined pattern on said insulating plate for coupling therethrough said first and second electrode terminals with each other and being covered by said coating insulator, said resistive layer being so arranged that the resistance of said resistive layer obtained per unit length on said insulating plate between said second electrode terminal and a high potential difference position between said first and second electrode terminals, where the potential difference between the outer surface of said coating insulator and said resistive layer is to be relatively large in the use of said resistor in the cathode ray tube, is greater than that between said high potential difference position and said first electrode terminal.

2. A resistor according to claim 1, wherein said resistive layer is made of substantially homogeneous resistive material with a substantially constant sectional area and formed in such a specific pattern that the substantial length of said resistive layer per unit length on the insulating plate between said second electrode terminal and said high potential difference position is longer than that between said high potential difference position and said first electrode terminal.

3. A resistor according to claim 2, wherein said resistive layer is formed in a zigzag pattern with a substantially constant meandering width and comprises a first portion provided with a first meandering pitch between said first electrode terminal and said high potential difference position and a second portion provided to be successive to said first portion with a second meandering pitch smaller than said first meandering pitch between said high potential difference position and said second electrode terminal.

4. A resistor according to claim 2, wherein said resistive layer is formed in a zigzag pattern with a substantially constant meandering pitch and comprises a first portion provided with a first meandering width between said first electrode terminal and said high potential difference position and a second portion provided to be successive to said first portion.with a second meandering width larger than said first meandering width between said high potential difference position and said second electrode terminal.

5. A resistor according to claim 1, wherein said resistive layer is made of substantially homogeneous resistive material and partially with different sectional areas so that the resistance in a unit length of said resistive layer between said second electrode terminal and said high potential difference position is larger than that between said high potential difference position and said first electrode terminal.

6. A resistor according to claim 5, wherein said resistive layer is formed with a substantially constant thickness and comprises a first portion provided with a first width of resistive layer between said first electrode terminal and said high potential difference position and a second portion provided to be successive to said first portion with a second width of resistive layer narrower than said first width of resistive layer between said high potential difference position and said second electrode terminal.

7. A resistor according to claim 5, wherein said resistive layer is formed with a substantially constant width and comprises a first portion provided with a first thickness between said first electrode terminal and said high potential difference position and a second portion provided to be successive to said first portion with a second thickness smaller than said first thickness between said high potential difference position and said second electrode terminal.

8. A resistor according to claim 1, wherein said resistive layer is made partially of different resistive material with a substantially constant sectional area so that the resistance in a unit length of said resistive layer between said second electrode terminal and said high potential difference position is larger than that between said high potential difference position and said first electrode terminal.

9. A resistor according to claim 8, wherein said resistive layer comprises a first portion made of first resistive material having first specific resistance and provided between said first electrode terminal and said high potential difference position and a second portion having second specific resistance larger than said first specific resistance and provided to be successive to said first portion between said high potential difference position and said second electrode terminal.

* * * * *